United States Patent [19]

Mallow

[11] 4,334,326

[45] Jun. 15, 1982

[54] KEY HOLDER

[76] Inventor: Thomas T. Mallow, 1133 Fifth Ave., New York, N.Y. 10028

[21] Appl. No.: 195,190

[22] Filed: Oct. 8, 1980

[51] Int. Cl.[3] ..... A41D 27/20

[52] U.S. Cl. ..... 2/249; 2/250

[58] Field of Search ..... 2/249, 247, 250, 254

[56] References Cited

U.S. PATENT DOCUMENTS

| | | | |
|---|---|---|---|
| 699,425 | 5/1902 | Strauss | 2/249 |
| 1,273,419 | 7/1918 | Stewart | 2/249 |
| 1,692,200 | 11/1928 | Capuano | 2/249 |

*Primary Examiner*—Doris L. Troutman

*Attorney, Agent, or Firm*—Bauer & Amer

[57] ABSTRACT

As an improvement to key holders of the type attached to a garment or the like, to prevent inadvertent loss or for other such reasons, the within holder has one end of a closed loop in stitched attachment to a supporting fabric panel and contemplates that the other free or unattached end be projected through a buttonhole of a pocket patch or closure flap, to thereby present a neat and distinctive appearance effectively serving as a display position for the key holder.

3 Claims, 14 Drawing Figures

KEY HOLDER

The present invention relates generally to attached key holders, the attachment being primarily to garments although not restricted thereto, and more particularly to improvements for such a key holder which contribute to providing the key holder with such a neat external or display position that the distinctive appearance thereof significantly correspondingly contributes to the commercial desirability of the garment.

As understood, for example, from U.S. Pat. No. 1,692,200, the attachment of a watch, key or other valuable item to a loop or the like which, itself, is in stitched attachment to a garment which obviates the loss of the item, adds to the convenience in the use thereof, as well as possibly providing other benefits. One benefit heretofore not provided however, is the use in the prior art of the attached key holder to provide a distinctive appearance to the garment which, assuming the garment is well constructed and from a well respected manufacturing source, can significantly contribute to the commercial desirability thereof. Undoubtedly the reason is that prior art garment-attached key holders have an unsightly appearance when worn outside of their cooperating storage pockets.

Broadly, it is an object of the present invention to provide an improved key holder, intended primarily for attachment to a garment, overcoming the foregoing and other shortcomings of the prior art. Specifically, it is an object to provide a key holder attached, for example, to a blouse, in which the external or display position thereof actually enhances the appearance of the blouse because of the distinctive "look" embodied in the key holder.

An improved key holder for a garment such as a blouse or the like, which demonstrates objects and advantages of the present invention is, in practice, attached to the blouse front panel fabric having an operative area delineated thereon for the attachment of a pocket. More particularly, a closed loop component of the holder has an operative condition of having an end in stitched attachment to the fabric at a selected location below a horizontally oriented reference line coincident with an upper edge of the pocket when in attached relation thereto. The within holder also includes means for removably connecting a key to the closed loop. Next in the manufacturing sequence, a pocket patch is attached in covering relation over the loop such that the upper unattached edge thereof bounding the opening into the pocket is operatively disposed above the attached end of the loop and along the horizontally oriented reference line so as to mask the presence of the loop. Said pocket patch has an opening, which can be simply a buttonhole, oriented in the width direction of the closed loop and sized to permit the unattached end of the loop to be projected therethrough, said buttonhole to this end being located in aligned relation to the closed loop. Thus, the closed loop and any key attached thereto can be worn either in an external display position projected through the pocket patch opening or in an unrevealed position within the pocket.

The above brief description, as well as further objects, features and advantages of the present invention, will be more fully appreciated by reference to the following detailed description of presently preferred, but nonetheless illustrative embodiments in accordance with the present invention, when taken in conjunction with the accompanying drawings, wherein.

Figure 2:
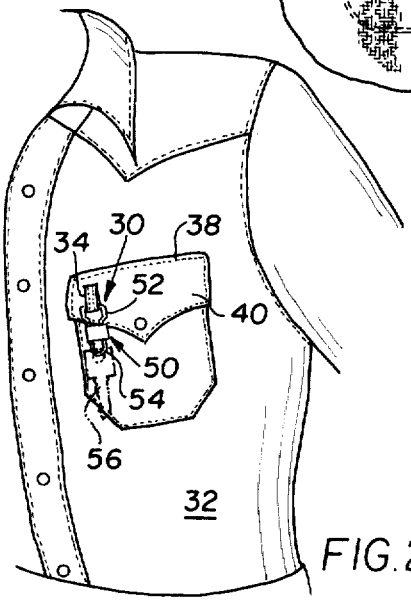
FIG. 2 is a partial perspective view illustrating the improved key holder hereof in attached relation to a man's shirt.
Figure 3:
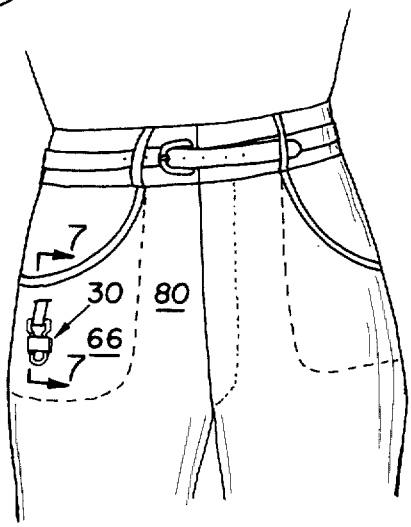
Figure 2A:
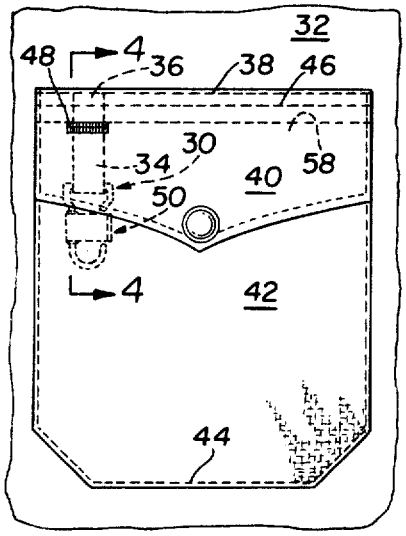
FIG. 2A is a partial front elevational view on an enlarged scale illustrating the attached key holder of FIG. 2 in its unrevealed or storage condition within the cooperating pocket of the shirt.
Figure 2B:
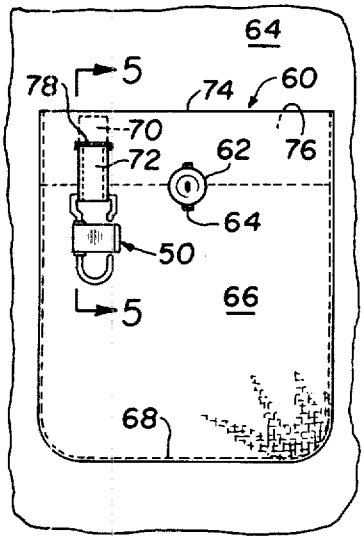
FIG. 2B is a partial front elevational view similar to FIG. 2A but illustrating the key holder in its exposed or display position and also in connection with another type of pocket.
Figure 2C:
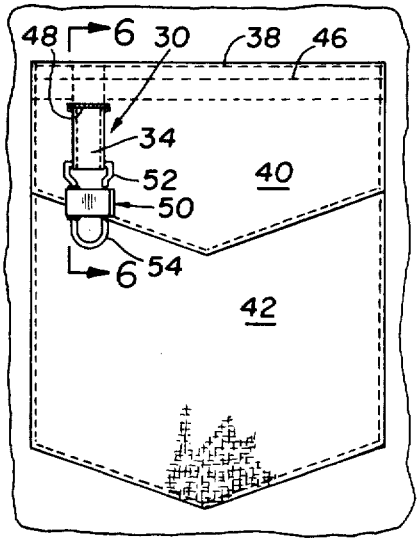
FIG. 2C is a view similar to FIGS. 2A and 2B but illustrating the key holder in association with still another type of pocket.
Figure 4:
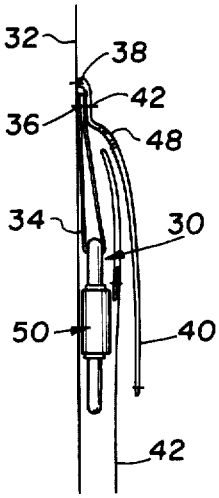
Figure 5:
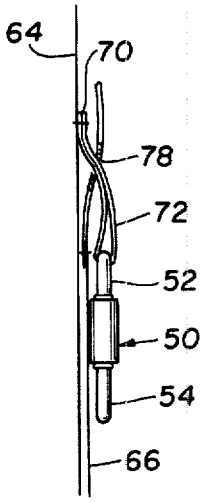
Figure 6:
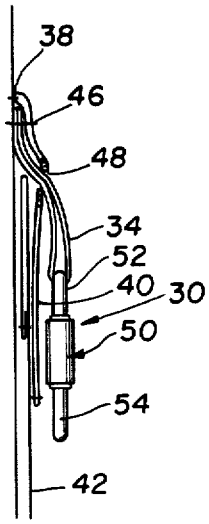
Figure 7:
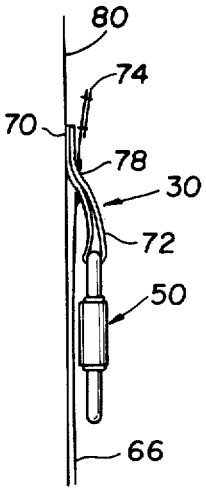
Figure 8:
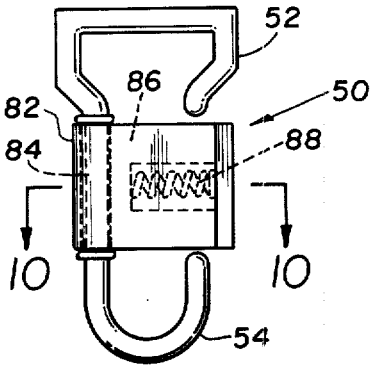
Figure 9:
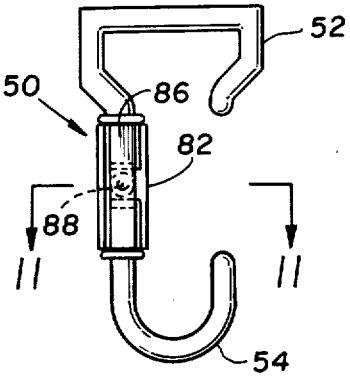
Figure 10:
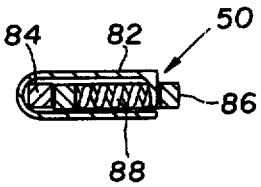
Figure 11:
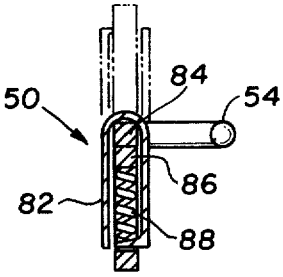

FIG. 3, like FIG. 2, is a partial perspective illustration of the within improved key holder, but in attached relation to slacks;

FIG. 4 is a side elevational view in section, taken along line 4—4 of FIG. 2A, illustrating the manner in which the key holder is supported within a pocket; FIG. 5 is similarly an elevational view in section taken along line 5—5 of FIG. 2B and illustrating the key holder in its exposed or display position;

FIG. 6 is also a sectional side elevational view, but taken along line 6—6 of FIG. 2C and illustrating further structural features of an embodiment of the within inventive key holder which is similar to the embodiment illustrated in FIGS. 2, 2A and 4;

FIG. 7 is still another sectional view in cross-section, taken along line 7—7 of FIG. 3, illustrating structural features of the key holder shown in attached relation to slacks;

FIG. 8 is an isolated front elevational view of an appropriate lock for attaching a key to the closed loop of the within key holder;

FIG. 9 is a side elevational view projected from FIG. 8 illustrating the lock in its open condition; and FIGS. 10 and 11 are plan views, in section respectively taken along lines 10—10 of FIG. 8 and lines 11—11 of FIG. 9, showing further structural details of the lock.

Figure 1:
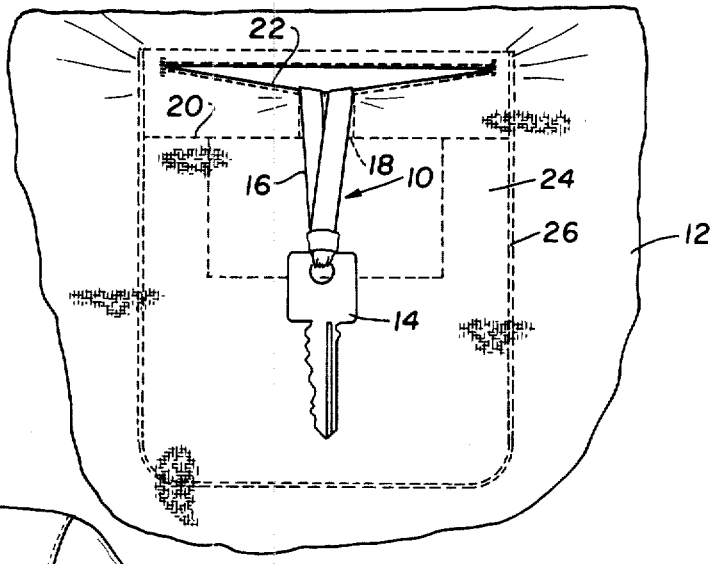
FIG.1 PRIOR ART
FIG. 1 is a partial front elevational view of a typical garment-attached prior art key holder in connection with which the inventive embodiments hereof provide significant and noteworthy improvements.

As understood, as for example from the description and illustrations of prior U.S. Pat. No. 1,692,200, and as herein illustrated in FIG. 1, the advantages of having a key holder, generally designated 10, actually physically attached to a garment 12, are well known. Said prior art holder 10 is, in practice, operatively associated with a valuable object such as a watch or, as shown, a key 14 and its attachment thus has utility in preventing inadvertent loss of the key or object 14. To achieve the physical attachment referred to, however, the prior art contemplates the use of a closed loop of tape 16 having one end attached, as at 18, along a line of stitching 20 which is below opening 22 of a pocket formed by a pocket patch 24 stitched to the supporting fabric 12 by peripheral stitching 26. The prior art key holder 10 constructed as just described provides the security of physical attachment of the key 14 to the garment 12 but has a shortcoming, apparent upon review of FIG. 1, of not providing a particularly pleasing appearance when the key 14 is supported externally as illustrated. More particularly, in the external position of the key 14, the looping of the strip 16 over the pocket upper edge 22 causes a sag therein which seriously detracts from the appearance of the arrangement when used during external display of the key 14. However, the prior art attachment of the key 14, as above described, readily permits the key 14 to be worn internally of the pocket, thus providing limited utility in this respect.

In contrast to the foregoing, the inventive key holder hereof can be worn in an unrevealed position within a pocket and also provides an external or display position for the key which is significantly characterized by a neat and pleasing appearance. As will be more apparent as the description proceeds, the within improved key holder can be applied to blouses, shirts, and other upper torso garments as well as to slacks and trousers, and even, although not shown, to headwear. It also can be applied, although not shown for brevity's sake, to luggage and the like. Further, because the within improved key holder is characterized by a neat and pleasing external or display position, it is intended principally for use on blouses and, to a somewhat lesser extent to other types of garments, and it therefore will be described in particular connection therewith.

Referring first to related FIGS. 2, 2A and 4, there is shown therein an improved key holder according to the present invention, generally designated 30, in an external or display position in FIG. 2 and also in its unrevealed or internal position with a cooperating pocket as illustrated in FIGS. 2A, 4. Still referring to FIGS. 2, 2A and 4, key holder 30 is supported on a shirt or blouse panel 32 and is comprised of a fabric strip 34 which is formed into a closed loop and attached adjacent one end, as at 36, to the fabric panel 32 by the run stitching 38 of a pocket closure flap 40. In the actual manufacturing sequence, pocket patch 42 is applied to the fabric 32 by peripheral stitching 44 and the end 36 of the closed loop 34 destined for attachment to fabric 32 is attached, along with the closure flap 40, to the fabric 32 by the referred to run stitching 38. Next top stitching 46 is applied to complete the stitched attachment of both the loop 34 and closure flap 40 to the supporting fabric panel 32.

An important structural feature of the within improved key holder 30 is the inclusion within the flap 40 of a finished buttonhole 48 oriented horizontally, rather than vertically, as is conventionally the case, and the alignment of the buttonhole 48 in superposed relation with the closed loop 34. As a result of this alignment and also of the horizontal orientation of the buttonhole 48 it is readily possible to project the free end of the closed loop 34 through the buttonhole 48 into the external position illustrated in FIG. 2. In the external or display position of the loop 34, it is contemplated that use will be made of a connecting member, generally designated 50, which may be of any one of many commercially available types, one of which for completeness' sake will be described subsequently, which has a hook 52 at one end for engaging the closed loop 34 and another hook 54 at its opposite end upon which in practice there would be typically placed a car key 56, as illustrated in phantom perspective in FIG. 2. Not only does the key holder 30 hereof have a neat FIG. 2 external or display position, but removal of connecting member 50 with an attached key permits the loop 34 to be withdrawn through the buttonhole 48 and placed in an unrevealed suspended position with the pocket compartment 58 provided by the pocket patch 42 as illustrated in FIG. 2A. Once loop 34 is withdrawn through the buttonhole 48 it is optional with the user whether or not to restore the connecting member 50 and any key attached thereto to the closed loop 34.

Reference should be made to FIG. 2C which is intended to supplement the illustration of the FIG. 2 external or display position of the key holder 30. Although a different pocket from a fashion point of view is displayed in FIG. 2C, the increased scale thereof as compared with FIG. 2 should help to demonstrate the neatness of the external or display condition of the within key holder. In FIG. 2C, the structural features of the key holder 30 already described in connection with FIGS. 2, 2A are designated by the same reference numerals. As should be readily appreciated from FIG. 2C, the aligned relation between the horizontally oriented buttonhole 48 and the free or unattached end of the closed loop 34 readily permits the latter to be projected through said buttonhole and thereby provides an appropriate means for supporting in display position from the closed loop 34 a key-attaching member 50 and, of course, any key attached thereto. The display of a car key or the like over a shirt or blouse pocket as hereinbefore described not only contributes to convenience in use of the key, but also has a fashionable aspect in that it contributes a distinctive appearance to the garment which, assuming it is well constructed and from a well respected manufacturing source, significantly enhances the commercial desirability of the garment.

Reference should now be made to FIG. 2B and its related cross-sectional view FIG. 5 which illustrate the application of the within improved key holder 30 to still another type of pocket 60. Pocket 60, instead of having a closure flap 40, is closed using a button 62 that is attached in a conventional manner to a shirt or blouse fabric panel 64 and is selectively engaged with a conventional vertically oriented buttonhole 64 provided in a pocket patch 66 attached by peripheral stitching 68 to the fabric panel 64. In the manufacturing sequence of the embodiment of FIG. 2B, it is contemplated that prior to stitched attachment of the patch 66 to the fabric 64 that the attached edge 70 of the closed loop 72 will be attached to the fabric 64 at a location which is slightly below the level along which the upper edge 74 of patch 66 is sewn in relation to the fabric 64. Thus the upper edge 74 which bounds the pocket compartment 76 which is provided by the patch 66 will mask the presence of the closed loop 72 of the key holder 30. However, when desired, loop 72 can be projected through the horizontally oriented buttonhole or opening 78 in the patch 66 to thereby provide, as already explained, an external or display position of any key-connecting member 50 and any key attached thereto which is placed in supported position on the free or unattached end of the closed loop 72.

For completeness' sake it is also mentioned that the within improved key holder 30 hereof can also be applied to a cooperating pocket of a pair of slacks or jeans 80 or the like. Structural details of the key holder 30 applied to this specific classification of garment can be readily appreciated from FIG. 3 and its related cross-sectional view of FIG. 7 in which structural features already described, particularly in connection with the embodiment of FIG. 2B, are designated by the same reference numerals used in FIG. 2B. Briefly, this embodiment, being applied to a pocket 66 that does not have a closure flap contemplates attaching end 70 of the loop 72 to the supporting fabric 80 at a location which, as is best illustrated in FIG. 7, is below the upper edge 74 of the pocket patch 66. Thus when loop 72 is withdrawn through the horizontally oriented buttonhole 78 and pocket patch 66 is in covering relation thereover, it provides an unrevealed or storage position for the key holder. On the other hand, as already described, the aligned relation between the buttonhole 78 and the loop 72 readily permits the loop to be projected into external or display position through the pocket patch 66 and thereby enables a suitable key chain or key holder member 50 to be visibly supported on the loop 72.

For completeness' sake reference should now be made to FIGS. 8, 9, 10 and 11 which illustrate one of many appropriate connecting members that can be used for detachably connecting a key or similar item to the end of the closed loops of the various embodiments of the within key holder 30 hereof. As illustrated in FIGS. 8–11, member 50 is a relatively inexpensive article of manufacture and includes a rectangular housing 82 along one side of which the previously referred to hooks 52 and 54 are connected by a length portion 84 which is square in cross-section. Cooperating with the shaped length 84 is a spring biased position-holding member 86, the biasing spring 88 of which is disposed in a medial compartment of the member 86. As may be readily appreciated by comparison of FIGS. 10 and 11, the hooks 52 and 54 which extend on opposite sides of the housing 82, can assume a position in the plane of the housing 82, as illustrated in FIG. 10, and also can be rotated out of this plane to positions of rotation as illustrated in full line and phantom line perspective in FIG. 11. The referred to positions of rotation are maintained under the slight spring pressure of spring 88 by virtue of the contact with the side of member 86 that is made with one of the flat surfaces of the square connecting length 84.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention herein.

What is claimed is:

1. An improved key holder for a garment or the like comprising, in combination, a fabric having an operative area delineated thereon for the attachment of a pocket, a closed loop having an operative condition of having an end in stitched attachment to said fabric at a selected location below a horizontally oriented reference line coincident with an upper edge of said pocket when in attached relation thereto, means for removably connecting a key to said closed loop, a pocket patch attached in covering relation over said loop having an upper unattached edge bounding the opening into said pocket operatively disposed above said attached end of said loop and along said horizontally oriented reference line so as to mask the presence of said loop, and said pocket patch having an opening oriented in the width direction of said closed loop and sized to permit said unattached end of said loop to be projected therethrough located in aligned relation to said closed loop, whereby said closed loop and any key attached thereto can be worn either in an external display position projected through said pocket patch opening or in an unrevealed position within said pocket.

2. An improved key holder in attached relation to an article of manufacture of fabric construction material comprising, in combination, a fabric surface for supporting said key holder having an operative area delineated thereon for the attachment of a pocket, a closed loop having an operative condition of having an end in stitched attachment to said fabric surface at a selected location below a horizontally oriented reference line coincident with an upper edge of said pocket when in attached relation thereto, means for removably connecting a key to said closed loop, a pocket patch attached in covering relation over said loop having an upper unattached edge bounding the opening into said pocket operatively disposed above said attached end of said loop and along said horizontally oriented reference line so as to mask the presence of said loop, and said pocket patch having an opening oriented in the width direction of said closed loop and sized to permit said unattached end of said loop to be projected therethrough located in aligned relation to said closed loop, whereby said closed loop and any key attached thereto can be worn either in an external display position projected through said pocket patch opening or in an unrevealed position within said pocket.

3. An improved key holder in attached relation to an article of manufacture of fabric construction material comprising, in combination, a fabric surface for supporting said key holder having an operative area delineated thereon for the attachment of a pocket of the type having a patch and closure flap, a closed loop having an operative condition of having an end in stitched attachment to said fabric surface at a selected location along a horizontally oriented reference line coincident with an upper edge of said pocket closure flap when in attached relation thereto, means for removably connecting a key to said closed loop, a pocket patch and a closure flap attached to said fabric surface, said pocket closure flap being attached in covering relation over said loop with said upper edge thereof operatively disposed along said horizontally oriented reference line so as to mask the presence of said loop, and said pocket patch having an upper unattached edge bounding the opening into said pocket operatively disposed below said attached end of said loop, and said pocket closure flap having an opening oriented in the width direction of said closed loop and sized to permit said unattached end of said loop to be projected therethrough located in aligned relation to said closed loop, whereby said closed loop and any key attached thereto can be worn either in an external display position projected through said pocket closure flap or in an unrevealed position within said pocket.

* * * * *